US007928025B2

(12) United States Patent
Shipley et al.

(10) Patent No.: US 7,928,025 B2
(45) Date of Patent: Apr. 19, 2011

(54) NONWOVEN MULTILAYERED FIBROUS BATTS AND MULTI-DENSITY MOLDED ARTICLES MADE WITH SAME AND PROCESSES OF MAKING THEREOF

(75) Inventors: Gale Shipley, Mooresville, NC (US); Anna Jean Sill, North Little Rock, AR (US); Stephen Foss, Naples, FL (US)

(73) Assignee: Polymer Group, Inc., Charlotte, NC (US)

( * ) Notice: Subject to any disclaimer, the term of this patent is extended or adjusted under 35 U.S.C. 154(b) by 142 days.

(21) Appl. No.: 12/243,066

(22) Filed: Oct. 1, 2008

(65) Prior Publication Data

US 2010/0081354 A1 Apr. 1, 2010

(51) Int. Cl.
*B32B 5/06* (2006.01)
*B32B 5/26* (2006.01)
*D04H 1/46* (2006.01)

(52) U.S. Cl. ..... 442/383; 442/402; 442/407; 428/212; 428/218; 428/220; 156/148

(58) Field of Classification Search ..... 442/383, 442/402, 407; 428/212, 218, 220; 156/148
See application file for complete search history.

(56) References Cited

U.S. PATENT DOCUMENTS

| | | | | |
|---|---|---|---|---|
| 2,059,132 | A | 10/1935 | McDermott | |
| 4,131,664 | A | 12/1978 | Flowers et al. | |
| 4,522,876 | A * | 6/1985 | Hiers | 442/388 |
| 4,568,581 | A | 2/1986 | Peoples, Jr. | |
| 4,935,295 | A * | 6/1990 | Serafini | 442/383 |
| 4,966,799 | A | 10/1990 | Lucca et al. | |
| 5,079,074 | A | 1/1992 | Steagall et al. | |
| 5,132,166 | A | 7/1992 | Adams et al. | |
| 5,387,382 | A | 2/1995 | Fottinger et al. | |
| 5,436,046 | A * | 7/1995 | Sakamoto | 428/36.2 |
| 5,741,380 | A | 4/1998 | Hoyle et al. | |
| 5,817,408 | A | 10/1998 | Orimo et al. | |
| 5,824,246 | A | 10/1998 | Reetz | |
| 5,841,081 | A * | 11/1998 | Thompson et al. | 181/286 |
| 5,853,510 | A | 12/1998 | Lawson | |
| 6,048,809 | A * | 4/2000 | Brow et al. | 442/364 |
| 6,296,076 | B1 * | 10/2001 | Hiers et al. | 181/290 |
| 6,572,723 | B1 | 6/2003 | Tilton et al. | |
| 6,669,265 | B2 | 12/2003 | Tilton et al. | |
| 6,726,980 | B2 | 4/2004 | Staelgraeve et al. | |
| 6,827,894 | B1 | 12/2004 | Tilton et al. | |
| 6,955,845 | B1 | 10/2005 | Poole et al. | |
| RE39,010 | E | 3/2006 | Gish et al. | |
| 7,011,181 | B2 | 3/2006 | Albin, Jr. | |
| 7,055,649 | B2 | 6/2006 | Tompson et al. | |

(Continued)

FOREIGN PATENT DOCUMENTS

EP 0717161 B2 3/2002

*Primary Examiner* — Norca L Torres-Velazquez
(74) *Attorney, Agent, or Firm* — Kilyk & Bowersox, P.L.L.C.; Valerie Calloway

(57) ABSTRACT

Thermal compression moldable nonwoven multilayered fibrous batts having substantially uniform density are provided, which are useful, for example, for fabrication of multi-density molded parts, such as multi-density molded vehicle liners. The nonwoven multilayered fibrous batts of uniform density comprising needle-punched first and second (and optionally third and/or fourth) fibrous batt layers formed with different fiber blends, wherein the multilayered batt can be molded into acoustical parts having multi-densities.

34 Claims, 7 Drawing Sheets

U.S. PATENT DOCUMENTS

| | | | | |
|---|---|---|---|---|
| 7,137,477 | B2 | 11/2006 | Keller et al. | |
| 7,157,137 | B2 | 1/2007 | Wenstrup | |
| 7,166,547 | B2 | 1/2007 | Tilton et al. | |
| 7,182,172 | B2 | 2/2007 | Albin, Jr. | |
| 2002/0137421 | A1 | 9/2002 | Desroches et al. | |
| 2003/0124940 | A1 * | 7/2003 | Michael | 442/391 |
| 2004/0231914 | A1 * | 11/2004 | Thompson et al. | 181/284 |

* cited by examiner

NONWOVEN MULTILAYERED FIBROUS BATTS AND MULTI-DENSITY MOLDED ARTICLES MADE WITH SAME AND PROCESSES OF MAKING THEREOF

TECHNICAL FIELD

The present invention relates to nonwoven multilayered fibrous batts, multi-density molded articles, such as but not limited to dual-density molded acoustical parts made with the batts, and processes for making the nonwoven multilayered fibrous batts.

BACKGROUND OF THE INVENTION

Plastic parts are extensively used in vehicle production. Molded polymeric fiber composites in particular are used in vehicle parts, such as liners and trims. These polymeric fiber composites often have performance specifications, such as the specifications associated with acoustical insulation. In constructs, such as interior vehicle parts, the weight of the molded part directly impacts upon the weight of the vehicle and ultimate efficiency of vehicle manufacture and operation along with the resistance of the molded part to deform or "sag". Some fabrications of molded fibrous composite parts in the past have required multiple step molding, non-reusable components, and/or non-uniform preforms. Multilayered batt products, for instance, are known in which the constituent layers have different densities as a premolded material.

U.S. Pat. No. 7,137,477 B2 discloses sound absorbers made by predensifying separate base materials containing textile fiber material and binder with heat and pressure, and superimposing the fabrics and bonding them by action of heat and pressure without an adhesive or needle punching. One of the base materials alternatively can be predensified before the other binder containing base material is pasted onto it in the mold and densified by heat and pressure.

U.S. Pat. No. 5,079,074 discloses a dual density non-woven batt comprised of first and second batt layers that are fused together, and the first batt layer has a relatively high density and the second batt layer has a relatively low density before and after compression molding.

U.S. Pat. No. RE 39,010 discloses a lightweight acoustical system comprising an impermeable layer and an underlayment having a specific airflow resistance between about 2000 and about 5000 mks Rayls, comprising first and second fibrous layers bonded with a semi-permeable layer.

U.S. Pat. No. 4,131,664 discloses a multi-density fibrous acoustical panel comprising fibrous pad formed by incorporating suitable binding agents and a coextensive impervious membrane or film disposed intermediate of the face surface thereof.

U.S. Pat. No. 5,387,382 discloses a method for manufacturing an interior fitted part for a motor vehicle in which a staple fiber formed fabric of drawn polyethylene terephthalate matrix component and a polyester-containing binding component is subjected to precompaction and at least once during the process to an annealing process before molding.

U.S. Pat. No. 5,817,408 discloses a sound insulation structure comprising a low density layer that is high in sound-absorption coefficient and a high density layer that is a low spring constant layer. Each of the low and high density layers comprises first and second layers solely made of a first fiber and a second fiber respectively.

U.S. Pat. Nos. 6,572,723 B1 and 6,669,265 B2 disclose multilayer liners and insulators and processes for forming them in which an insulator precursor is disclosed that is formed with a polymer based blanket material formed from two composite layers having significantly different softening points or temperatures that are adhesively attached.

SUMMARY OF THE INVENTION

The present invention is directed to nonwoven multilayered thermal compression moldable fibrous batts having substantially uniform density in which a significant density difference is producible between different fibrous batt layers upon thermal compression molding thereof. These batts can be used, for example, in the fabrication of multi-density thermal compression molded articles, such as acoustical parts, and in other acoustical applications. The present invention is also directed to processes for making the nonwoven multilayered fibrous batts with substantially uniform density and multi-density thermal compression molded products made therefrom.

In one embodiment, a nonwoven multilayered thermal compression moldable fibrous batt with substantially uniform density is provided comprising needle punched first and second fibrous batt layers comprising first and second discontinuous fibers in different proportions, wherein the melt point of the first discontinuous fiber is at least 30 degrees Celsius less than melt point of the second discontinuous fiber at the same ambient conditions. The first and second fibrous batt layers are united by a needle-punched intertufted region formed between opposite surfaces of the overlaid batt layers. The nonwoven multilayered thermal compression moldable fibrous batt has substantially uniform density. In various embodiments, the proportional amount of the first discontinuous fiber is at least 5% different in the first fibrous layer when compared to the second fibrous batt layer. For example, if the first fibrous layer contains 25 wt. % first discontinuous fiber based upon the weight of the layer, then the second fibrous batt layer contains at least 30 wt. % of the first fiber based upon the weight of the layer. The fibrous batt layers are needle punched together effective to form a consolidated batt having substantially uniform density throughout. In various embodiments, the first and second fibrous batt layers of the needle punched nonwoven multilayered compression moldable fibrous batt have respective densities that are within 12% of each other. A significant density difference is producible between the first and second fibrous batt layers of the nonwoven multilayered thermal compression moldable fibrous batt having substantially uniform density upon thermal compression molding thereof.

With fibrous batts of the present invention, it is possible to custom mold a wide variety of multi-density molded articles having desired acoustical properties from a single nonwoven fibrous multilayered thermal compression moldable batt of the present invention. By controlling molding thickness, for example, the nonwoven multilayered fibrous batts constructed in accordance with various embodiments of the present invention can be custom molded in a single molding step into multi-density parts tailored to provide different balances of sound transmission loss and sound absorption properties. Further, the nonwoven multilayered batts can be custom molded in a single molding step into a wide variety of multi-density parts without need for redesigning the thermal compression moldable fibrous batt of the invention. In addition, the first and second fibrous batt layers of the nonwoven multilayered fibrous thermal compression moldable batt can be consolidated into a unitary nonwoven multilayered batt structure without need of any extraneous adhesive binders, preform fusion bonding or annealing. The first and second types of fibers also can comprise substantially the same or different fiber finish. In addition, the constituent batt layers can be formed using only two different types of fibers. These features reduce production costs and complexity.

In another embodiment, a process is provided for making a nonwoven multilayered thermal compression moldable fibrous batt comprising forming first and second precursor web layers comprising blends of first and second discontinuous fibers in different proportional amounts, wherein the first discontinuous fiber melt point is at least 30 degrees Celsius less at ambient conditions than the melt point of the second discontinuous fiber. In further embodiments, first and second precursor web layers can comprise blends of first and second discontinuous fibers in different proportional amounts, wherein the first discontinuous fiber melt point is at least 60 degrees Celsius less, or is at least about 80 degrees Celsius less, or is at least 100 degrees Celsius less, at ambient conditions than the melt point of the second discontinuous fiber. The precursor web layers are overlaid to form a nonwoven precursor web that is needle punched from opposite sides to unite the first and second precursor web layers and to form an intertufted region between opposite sides of the needled punched nonwoven precursor web, thereby forming a nonwoven multilayered thermal compression moldable fibrous batt with substantially uniform density. The needle punching can be conducted simultaneously or sequentially in separate stages from opposite sides of the nonwoven precursor web. Needle penetration depths from both sides extend partially through the thickness of the nonwoven precursor web to form the intertufted region between the opposite outer surfaces of the web that joins the batt layers via an intertufted region. The needle punching equilibrates the densities of the precursor web layers and the density of the needled thermal compression moldable batt is made substantially uniform. In various embodiments, the first and second precursor web layers can have basis weights that differ by more than about 10%, or at least about 25% and no more than about 50% prior to the needle punching, and yet can be needle punched into a batt having substantially uniform density by methods of the present invention. A needle punched multilayered batt is provided in which the precursor layers do not need to be individually needle punched or molded before they are joined into a unitary fibrous batt. The fiber proportions used in the first and second fibrous batt layers can be similar to those described herein with respect to the precursor web layers.

The resulting needle punched nonwoven multilayered fibrous batt having uniform density can be thermal compression molded into various acoustical parts in a one-step molding process. The molded parts can be fabricated using batts according to embodiments of the present invention which are formed predominantly or essentially completely with recyclable, environmentally-friendly materials. Further, the nonwoven multilayered fibrous batts can be used, for example, as blanks for making vehicle liners that absorb sound and reduce noise in the interior compartment of a vehicle. Also, the nonwoven multilayered fibrous batts can be used to form lighter molded parts than traditional plastic parts, making it possible to manufacture more efficient vehicles that consume less fuel. Another advantage of the nonwoven multilayered fibrous batts of the present invention is that they can provide improved acoustic properties in parts molded to thinner thicknesses.

By adjusting molding thickness imparted to the molded part, for example, it is possible to custom form molded parts having significantly different balances of acoustical properties from the same or similar starting multilayered fibrous batts of the present invention. In one embodiment, a dual density molded article, when made from the same starting multilayered batt material according to embodiments herein, exhibits a different balance of sound absorption and sound transmission loss properties, depending on the molded part thickness that is formed. For example, at a molded thickness of about 9 mm to about 11 mm, a dual density molded part made from the nonwoven multilayered batts of the invention can exhibit a sound transmission loss of about 1 to about 5 (dB), a primary absorption peak in the range of about 0.65 to about 0.75 between 4000 to 5000 Hz and an airflow resistance of about 200 Rayls to about 450 Rayls. By comparison, a dual density molded part made from the same multilayered fibrous batt at a molded thickness of about 3 mm to about 7 mm, can exhibit a sound transmission loss of about 10 to about 15 (dB), a primary absorption peak in the range of about 0.5 to about 0.6 between 2500 to 5000 Hz and an airflow resistance of about 2000 Rayls to about 4500 Rayls. Thus, the nonwoven multilayered batt is a highly versatile starting material allowing a molder to mold the starting batt to a thickness providing the best match with the specified or desired balance of acoustical properties for the molded part or component.

In further various embodiments, the first fibrous batt layer comprises at least 1% and not greater than 25% by weight of the layer of lower melt point first discontinuous fibers and the second fibrous batt layer comprises at least 30% by weight of the second layer of first discontinuous fibers. The first fibrous batt layer also can be formed with at least 1% and not greater than 25% by weight of the layer polyolefin fibers and at least 75% and not greater than 99% by weight polyester fibers; and the second fibrous batt layer can comprise at least 30% by weight of the second layer polyolefin fibers and up to 70% by weight of the second layer polyester fibers. In further various embodiments, the proportion of the lower melt first discontinuous fiber in the first batt layer is different from its proportion in the second batt layer by at least 10%, or at least 15%, or at least 20%, by weight. In another further embodiment, the first and second fibrous batt layers of the nonwoven thermal compression moldable multilayered fibrous batt have respective densities that are within 10%, or within 5%, or within 1% (in units of mass/volume), of one another. In another embodiment, at least a 12%, or 18%, or 24%, or 30%, density difference is producible in the first and second batt layers upon thermal compression molding of the nonwoven multilayered fibrous batt.

Other features and advantages of the present invention will become readily apparent from the following detailed description, the accompanying drawings, and the appended claims. It is to be understood that both the foregoing general description and the following detailed description are exemplary and explanatory only and are only intended to provide a further explanation of the present invention, as claimed.

DEFINITIONS

Figure 1:
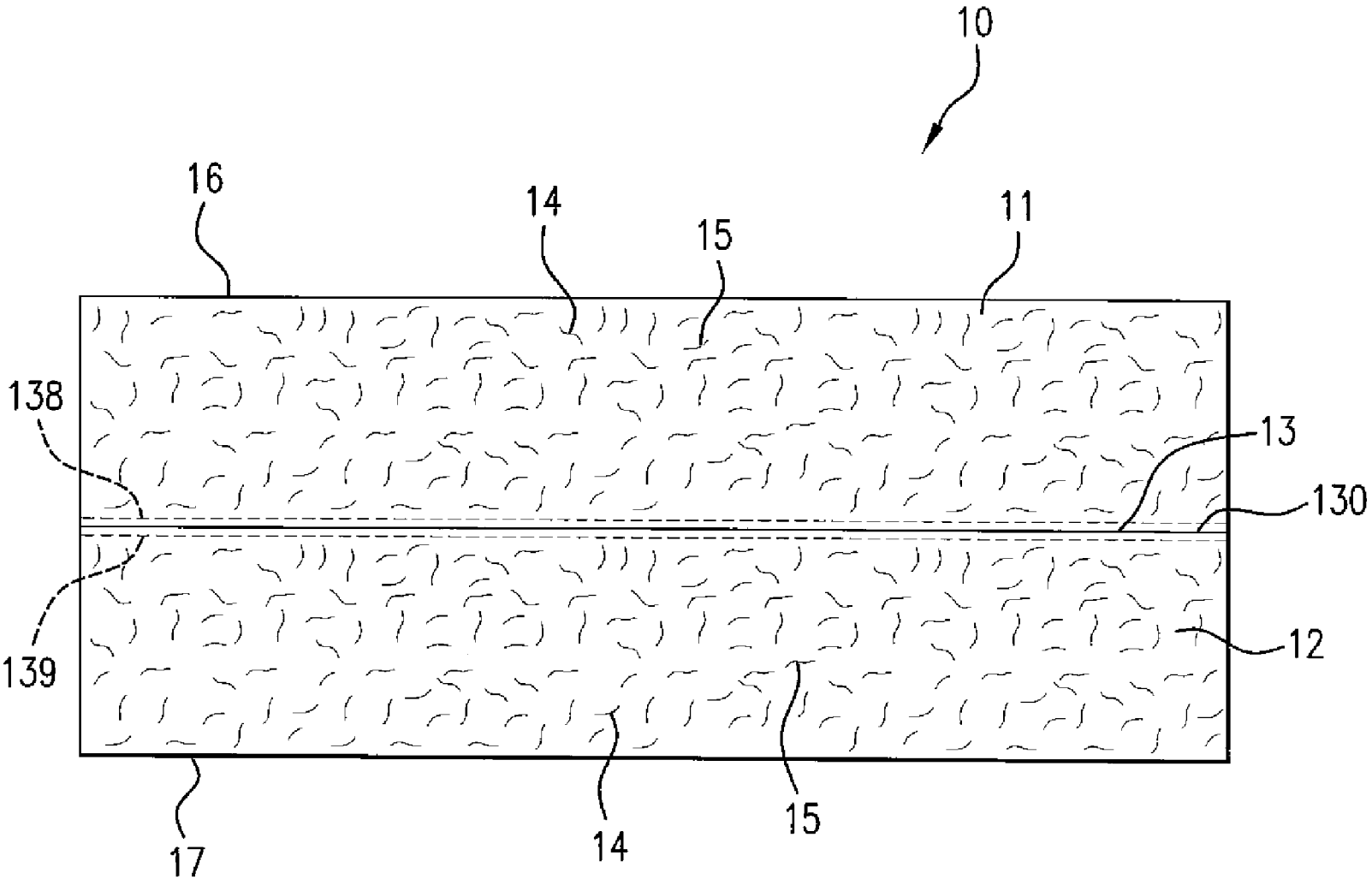
FIG. 1 is a cross-sectional view of a nonwoven multilayered thermal compression moldable fibrous batt according to an illustrative embodiment of the present invention.

As used herein, "density" refers to fabric density in units of mass/volume, such as g/cm$^3$. As used herein, "multi-density" or "multi-densities" refers to dual-density, tri-density, and/or quad-density (i.e., 2, 3, and/or 4 density) regions or layers.

As used herein, "basis weight" refers to fabric weight defined in terms of mass/surface area, such as g/m$^2$ (gsm).

As used herein, "substantially uniform density" when used to refer to a nonwoven layer or batt density (mass/volume), refers to a 12% or less difference in density.

As used herein, "significantly more dense" refers to greater than 12% more dense. As used herein, "significant density difference" refers to a density difference that is greater than 12%. For example, the term "significant density difference" when used to refer to a nonwoven density of two different batt regions or layers means that the two batt layers have a greater than 12% difference in density relative to each other. "Density difference" percentage, with respect to two molded or unmolded fibrous layers, is determined as an absolute value of the difference in the batt layer densities divided by the density of the denser batt layer, then multiplied by 100 (e.g., density difference=[(denser batt layer 1 density−less dense batt layer 2 density)/denser batt layer 1 density]×100).

As used herein, an "intertufted region" refers to a region in a batt between opposite sides of the multilayered nonwoven batt where two nonwoven fibrous batt layers are joined by needle punching of the two nonwoven fibrous batt layers from opposite sides of and partially through the thickness of the batt wherein the tufting from opposite directions overlaps at the intertufted region.

As used herein, "nonwoven multilayered fibrous batt" refers to a unitary, non-laminar homogenous fibrous structure made from plural "layers" that are fibrous and formed of different compositional homogenous fiber blends, and not discrete fiber layers laminated together.

As used herein, "melt" or "melting" refers to the transformation of the fiber in which the polymer softens and becomes sufficiently tacky to cling to other fibers within which it comes in contact, including other fibers having its same characteristics and adjacent fibers having a higher melting temperature. Melting of the fibers in the batt layers causes them to fuse to themselves and to other fibers in the batt which have not melted.

For purposes herein, acoustical properties of molded articles, inclusive of normal incidence sound absorption and normal incidence transmission loss, are determined by samples tested according to ASTM E1050-98. Airflow resistance of the molded samples, which is defined herein in units of Rayls, are determined using a C522 Gas Permeameter that measures pressure difference and flow rate in the ranges recommended by ASTM standard C522-03.

As used herein, "free of fusion prebonding" refers to a multilayered fibrous batt that has not been thermally tackified or fusion bonded prior to molding.

As used herein, "same ambient conditions" refers to same environmental conditions, such as atmospheric humidity, pressure, composition and temperature. Same ambient conditions can encompass, for example, an atmospheric air pressure value of about 1 bar and an ambient room temperature value of about 15-30 degrees Celsius.

As used herein, "different proportional amounts" refers to at least two components present in different proportions by weight. For example, a 10% proportional amount defined with respect to a fiber component A of a fiber blend or mixture containing fiber components A and B refers to a value of A/(A+B) that equals 0.1 or 10%. Proportional amounts are defined gravimetrically for purposes herein.

As used herein, "acoustical" refers to an item that is sound absorbing and that reduces sound transmission loss.

Unless indicated otherwise, "polyester(s)" as used herein refers to a polyalkylene terephthalate, such as polyethylene terephthalate ("PET"). Unless indicated otherwise, "co-polyester(s)" as used herein refers to a chemically modified polyester, a homogeneously mixed blend of polyesters, and/or an extruded blend of polyesters. As used herein, "low melt co-polyester" refers to a co-polyester that has a melt point of at least 100 degrees Celsius and not greater than 180 degrees Celsius. Unless indicated otherwise, "high melt co-polyester" as used herein refers to a co-polyester that has a melt point of greater than 180 degrees Celsius.

Unless indicated otherwise, the term "polyolefin" refers to a polymer having repeat units comprised of carbon and hydrogen atoms without ring structures. Polyalkylenes and acyclic polyalkylene copolymers are illustrative.

As used herein, "comprising" is synonymous with "including," "containing," "having", or "characterized by," and is inclusive or open-ended and does not exclude additional, unrecited elements or method steps.

For purposes herein, "consisting essentially of", restricts to the specified materials or steps and those that do not materially affect the basic and novel characteristic(s) of the invention.

As used herein, "consisting of" excludes any element, step, or ingredient not specified.

DETAILED DESCRIPTION

The present invention relates to thermal compression moldable needle-punched nonwoven multilayered fibrous batt materials having substantially uniform density that contain different fiber compositions in different layers thereof. The nonwoven multilayered fibrous materials can be used to make multi-density molded parts, such as acoustical components, in a single molding step. The fiber compositions used to construct the constituent fibrous layers of the batt can comprise blends of different fibers having different melt properties. Needle punching conducted from opposite sides of the construct can be used to consolidate the different fibrous layers into a unitary batt structure having substantially uniform density. By varying the proportions of the different fibers having different melt properties in different layers of the batt, the batt layers can be induced to mold to different densities relative to each other. In addition, the nonwoven multilayered fibrous materials having substantially uniform density permit custom molding of different parts having different acoustical characteristics using the same or similar starting batt material. Materials and articles of the invention have improved properties and performance, such as measured by a variety of tests including exemplary ones described herein.

Referring to the drawings and in particular FIG. 1, in various exemplary and non-limiting embodiments, a nonwoven multilayered thermal compression moldable fibrous batt 10 having substantially uniform density throughout is provided which comprises fibrous batt layers 11 and 12 comprising different blends of fibers having different melt properties. The batt layers 11 and 12 have an interface 130. The batt layers 11 and 12 are joined by an intertufted region 13. The intertufted region 13 extends across the interface 130 between uppermost and lowermost tufting levels 138 and 139 within the batt. The intertufted region 13 is formed by a cross-directional mechanical needle punching treatment, disclosed and illustrated in more detail below. It comprises a generally horizontally extending region located between and spaced from opposite sides 16 and 17 of the batt 10 in which fibers have been vertically displaced from one batt layer into the adjoining batt layer by vertical cross-directional needle punching in sufficient numbers and depths to physically connect the separate batt layers 11 and 12 together into a unitary material. The batt layers 11 and 12 are homogenous discontinuous fiber blends comprising fibers 14 and different fibers 15 having different melting temperatures. Batt layers 11 and 12 contain the different fibers in different proportions. Needle punched batt 10 has a unique construction and composition, which is evidenced by its molding capabilities. One of the batt layers 11 or 12 densifies differently than the other when batt 10 is thermal compression molded, such that a desired dual density molded article can be formed from the substantially uniform density unneedled batt 10.

In various embodiments, the batt layers (e.g., 11 and 12) are formed from fiber blends of two or more different types of staple fibers, including relatively high melting temperature ("high melt") staple fibers, and relatively low melting temperature ("low melt") polymeric staple fibers. The difference in melt temperatures of the fibers makes it possible to heat the combinations of fibers present in a nonwoven fabric placed in a mold at a temperature high enough to soften the low melt fibers but not the high melt fibers. When heated in such a manner, the low melt fibers can form bonds and serve to bind together the fibers and provide the desired stiffness and shape retention characteristics. In various embodiments, the low melt staple fibers have a melting temperature that is significantly less or lower in value at ambient conditions than the melt point or melting temperature of the high melt staple fibers. The melting temperatures of the first and second fibers preferably differ sufficiently that molding conditions can be reliably controlled to selectively induce softening of only the first fibers within a fibrous batt comprised of the first and second fibers without softening the second fibers. The high melt fibers preferably comprise the major fibrous component of each batt blend, and they may be blended with one or more types of low melt polymeric fibers, such as olefin polymers and copolymers, and other suitable thermoplastic fibers.

As indicated, there is a significant difference between the melting points of the low melt thermoplastic fibers and the high melt fibers. In various embodiments, the low and high melt fibers have melt temperatures that differ by at least about 30° C., at least about 60° C., or at least about 80° C., or at least about 100° C. For example, as one illustrative non-limiting example, the low melt fiber could be polypropylene fibers having a melting temperature of about 153-158° C. and the high melt fibers could be PET fibers having a melting temperature of about 245-255° C. Other melt temperature spreads also may be used. Discontinuous and staple length polymer fibers can be provided by a conventional meltblown process, fiber/filament chopping, and so forth. The staple length and diameter of each type of fiber used in the batt layers is not particularly limited as long as the fiber is amenable to being blended and formed into homogenous fiber blends. In various embodiments, staple lengths can be used ranging from about 10 mm to about 105 mm, or more preferably about 35 mm to about 76 mm. Other staple lengths also may be used. In addition, a mixture of staple fibers having different lengths can be used for either one or both of the types of the fibers used in a fiber blend. Fiber denier can be selected from a wide range of deniers. In various embodiments, the fiber denier can be in a range of about 1 to about 20 denier per filament, or about 1.5 to about 8 denier per filament (dpf), or other deniers can be used.

The presence of small amounts of continuous filaments in the batts of this invention is not categorically excluded, although in general should be minimized to amounts not interfering with fiber treatments, for example, such as carding, crosslapping, and/or needle-punching. The low and high melt fibers can have the same or different finish. The process of the invention is not dependent on this feature. If present, a standard low fume fiber finish can be used. The fibers may be suitably colored with the use of dyes, or by the incorporation of pigments into the polymer, as is conventional.

Non-limiting examples of the chemical types of low melt fibers include polypropylenes (e.g., isotactic, amorphous, etc.), polyethylenes (e.g., low-density, high-density, etc.), polybutylene, ethylene/vinyl acetate copolymer, ethylene/ethyl acrylate copolymer, ethylene/methyl acrylate copolymer, polystyrene, polyvinyl chloride, polyvinylidene chloride, aliphatic polyamides (PA-11), polyurethanes, low melt co-polyesters, such as, but not limited to, PETG (i.e., PET with the terephthalic acid replaced with ethylene glycol), and blends, alloys or combinations thereof. In various embodiments, the preferred low melt fibers for use in this invention can be polypropylene fibers, which are typically blended with high melt polyester fibers. Optionally, other low melt fibers may be added to each blend. In a preferred construction the polypropylene fibers are the predominant or sole low melt fiber used in each batt layer. Suitable high melt fibers include, for example, polyesters (polyalkylene terephthalates such as polyethylene terephthalate (PET), polybutylene terephthalate (PBT)), high melt co-polyesters, aromatic polyamides (poly m-phenylene isophthalamide (PMPI), poly p-phenylene terephthalamide (PPPT)), aliphatic polyamides (PA-4, PA-6, PA-7, PA-6,6), polycarbonate, polyacrylonitrile, polyphenylene sulfide, polyvinyl alcohol, natural fibers, such as but not limited to cotton, and blends, alloys or combinations thereof. It will be appreciated that the above illustrations of low melt and high melt types of fibers are merely exemplary, and that fibers identified above also could be used as the other type of fiber, depending on the different companion fibers and associated melting properties used in the mixture therewith. For example, it will be appreciated that compositions of the fibers could be manipulated to change (reverse) the low melt and high melt classifications of a particular combination of different types of fibers. If low melt co-polyester and PET, are used, for example, then the trimmings generated from the molding process could be recycled back into the PET fibers and reused in another multilayered fibrous batt.

In various embodiments, preferred high melt fibers are polyester fibers. In various embodiments, homopolymer fibers are used. Bicomponent (e.g., sheath-core) and other composite fiber constructions also may be used, where the diverse polymer constituents of such composite fibers may be all low melt, all high melt, or both types, depending on melting temperature(s) of other fibers co-present in the batt layer. Natural or inorganic fibers optionally may be included in the batt layers, such as but not limited to in minor amounts. In a preferred embodiment it is desirable to maximize the amount of re-usable and recyclable polymeric content of the batt layers. In a preferred embodiment, thermoplastic fibers are used for both the low melt and high melt fiber content of the batt constructed in accordance with the present teachings.

In various embodiments, one of the batt layers of the nonwoven multilayered fibrous batt, such as one of batt layers 11 and 12 of batt 10 illustrated in FIG. 1, will mold more "lofty" (less densely) than the other batt layer, which molds relatively more densely, as a function of the different relative proportion of low melt fiber in the layers. In various embodiments, the proportion of low melt fiber in the two (or more) batt layers differs by at least about 5%, or at least about 10%, or at least about 20% by weight of the respective layer. In other embodiments, the batt layer that molds more lofty than the other batt layer (or layers) of the batt comprises at least 1% and no greater than 25% by weight low melt fibers, and the other batt layer (or layers), which molds more "densely" than the other batt layer (or layers), under similar molding conditions, comprises at least 30% by weight of the layer low melt fibers. Although this illustration shows a dual-density embodiment in which batt 10 includes two batt layers having fiber mix ratios in which the low melt fiber content differs therebetween by at least 5%, it will be understood that the present invention also encompasses other multi-density embodiments in which the batt 10 can be constructed with three or four batt layers having respective fiber blend ratios in which the low melt fiber content differs by at least 5% between each directly adjoining pair of the batt layers in the construction. This allows for density to be tailored in two or more regions (e.g., two, three or four regions) of a molded product made from the batt.

In one preferred dual-density embodiment, one batt layer comprises at least 1% and no greater than 25% by weight of this batt layer polyolefin fibers and at least 75% and no greater than 99% by weight of this batt layer polyester fibers, and the other batt layer comprises at least 30% and no greater than 90% by weight of this batt layer polyolefin fibers and at least 10% and no greater than 70% by weight of this batt layer polyester fibers. In another preferred embodiment, one of the batt layers comprises at least 5% and no greater than 25% by weight of this batt layer polypropylene fibers and at least 75% and no greater than 95% by weight of this batt layer polyester fibers, and the other batt layer comprises at least 30% and no greater than 60% by weight of this batt layer polypropylene fibers and at least 40% and no greater than 70% by weight of this batt layer polyester fibers.

In yet another embodiment, other multi-density embodiments can be provided. For example, the batt 10 can be assembled with three or four batt layers having respective fiber mix ratios in which the low melt fiber content differs by at least 5% between each directly adjoining pair of the batt layers in the construction. A three batt layer construction could comprise, for example, batt layers containing 25%, 30%, and 35% low melt fiber, respectively, or 20%, 40%, and 30%, respectively, and so forth. For instance, a four batt layer construction could comprise batt layers containing 15%, 30%, 45% and 60% low melt fiber, respectively, or, 20%, 50%, 40%, and 30% low melt fiber, respectively, and so forth. As illustrated, while satisfying the at least 5% difference in low melt fiber content in adjoining batt layers, the amount of differences in low melt fiber content provided between each pairing of adjacent batt layers in a batt construction also can be uniform or non-uniform, and/or may or may not progressively increase/decrease, from layer to layer through the stack of batt layers of the batt. Other fiber combinations also may be used within the general requirements described herein.

Figure 2:
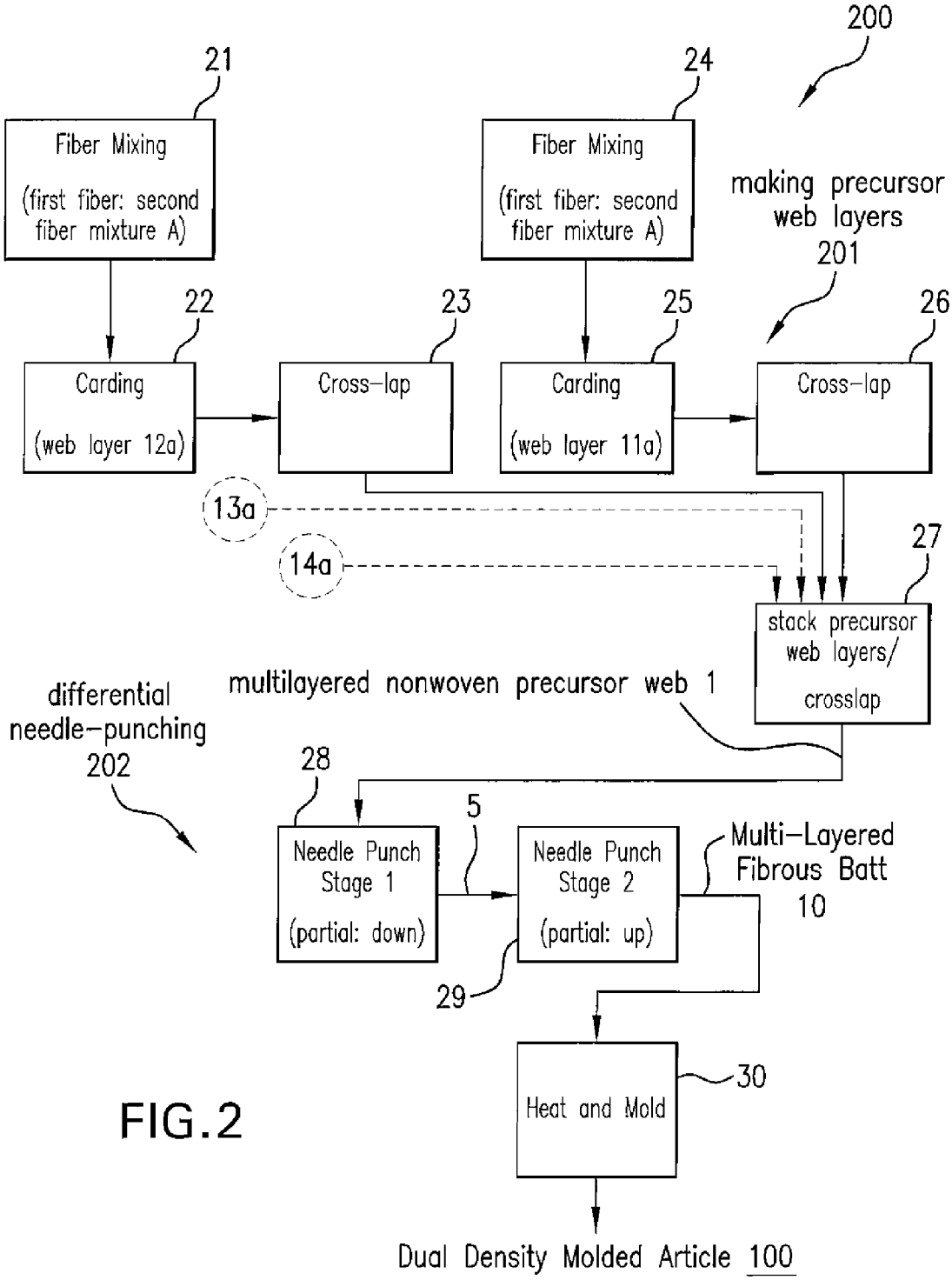
FIG. 2 is a flow chart showing a process for making a nonwoven multilayered thermal compression moldable fibrous batt and a molded article according to illustrative embodiments of the present invention.

Referring to FIG. 2, a process 200 for making a nonwoven multilayered thermal compression moldable fibrous batt 10 is illustrated. This illustrated process scheme is exemplary only. In this illustration, process steps 21-27 are generally provided for making precursor web layers, indicated generally as process line portion 201, comprised of different low and high melt fiber blends, into a multilayered nonwoven precursor web. The multilayered nonwoven precursor web 1 is subjected to needle-punching indicated generally as process line portion 202, such as illustrated as comprising needling steps 28 and 29, to provide a needle punched thermal compression moldable nonwoven multilayered fibrous batt 10 of substantially uniform density. The needle punched nonwoven multilayered fibrous batt 10 can be sized and/or packaged (not shown) and subsequently unwound and/or unpackaged (if necessary) and thermal compression molded in step 30 to provide a dual density molded article 100.

Still referring to FIG. 2, the precursor web layers made with different low melt/high melt fiber mixtures can be provided by use of multiple cards fed with different preselected fiber mixtures and crosslapping. In various embodiments, the first step is to form precursor web layers 11*a* and 12*a* of staple fibers comprising different proportions of low and high melt fibers. For example, staple-length low melt and high melt fibers can be respectively fed from supply hoppers into a mixer box for fiber mixing 21 at a preselected mixing ratio to provide fiber mixture "A."

As illustrated in FIG. 2, the fiber mixture A is fed to a carding machine for carding 22. The carding process produces a fibrous structure or web layer, which is fed, for example, onto a conveyor belt or apron (not shown), to a crosslapper for crosslapping 23, where lapper aprons crosslap the carded web layer by traversing a carrier means such as an intermediate apron in a reciprocating motion, to produce a precursor web layer 12*a*, the fibers of which can be oriented primarily in the transverse direction. The number of layers needed exiting the cross lapper depends upon the fiber denier, the speed of the cross lapper, the maximum through put of the cross lapper, the desired web layer density, and the desired multilayered fibrous batt width. The cross-lapper can orient fibers of the carded web(s) at an angle relative to the machine direction of the resultant web. A precursor web layer 11*a* is formed similarly by steps including a fiber mixing step 24, followed by carding in step 25, and crosslapping in step 26. A fiber mixture "B" is provided in fiber mixing step 24 that has a different mixing ratio of the staple-length low melt and high melt types of fibers than used to form fiber mixture A. The low and high melt fibers can be fed from supply hoppers into a different mixer box for fiber mixing 24 at a different preselected mixing ratio to provide fiber mixture B. The fiber mixture B is fed to a second carding machine for carding 25 and then crosslapped 26. The formed precursor web layer 11*a* is overlaid on precursor web layer 12*a*, and the stack of precursor web layers is crosslapped without changing the compositions of the respective web layers 11*a* and 12*a*. The resulting intermediate is multilayered nonwoven precursor web 1. In this illustration, nonwoven precursor web 1 contains a homogenous blend of the low and high melt fibers in each of web layers 11*a* and 12*a*. In various non-limiting embodiments, for example, fiber mixture A used in forming a relatively more dense when molded type web layer 12*a* can comprise a 35:65 to 50:50 wt:wt mixing ratio of low melt to high melt fibers, and fiber mixture B used in forming a "relatively more lofty" when molded type web layer 11*a* can comprise a 10:90 to 20:80 wt:wt mixing ratio of low melt/high melt fibers. Other low melt/high melt fiber blends also can be used provided that the relative proportions of low melt and high melt fibers are different for each precursor web layer.

Although illustrated as constructed from two precursor web layers 11*a* and 12*a*, it will be appreciated that precursor web 1 also optionally can be assembled having three or four precursor web layers. For example, one or both of the additional precursor web layers 13*a* and 14*a*, indicated by hatched lines in FIG. 2, optionally can be included in the construction of precursor web 1. Optional precursor web layers 13*a* and 14*a* could be formed on the same or different fiber mixing, carding and cross-lapping equipment as used to form layers 11*a* or 12*a*, and then these web layers can be assembled with web layers 11*a* and 12*a* in step 27. In another alternative, layers 13*a* and 14*a* can be formed into a precursor web (not shown) that is separate from precursor web 1 to provide two precursor webs which can be needle-punched together at station 202.

Illustrations of several fiber mixtures precursor web build-ups in accordance with non-limiting embodiments of the present invention are described below as Precursor Web Constructs 1, 2 and 3.

Precursor Web Construct 1: 1000 gsm precursor web layer (10% 12-20 dpf polypropylene (PP)/90% 6 dpf×3 inch regenerated polyethylene terephthalate (PET) over a 800 gsm precursor web layer (50% 12-20 dpf PP/50% 6 dpf×3 inch regenerated PET).

Precursor Web Construct 2: 1000 gsm precursor web layer (10% 12-20 dpf PP/90% 6 dpf×3 inch regenerated PET) over a 800 gsm precursor web layer (35% 12-20 dpf PP/65% 6 dpf×3 inch regenerated PET).

Precursor Web Construct 3: 1000 gsm precursor web layer (25% 12-20 dpf PP/75% 6 dpf×3 inch regenerated PET) over a 800 gsm precursor web layer (50% 12-20 dpf PP/50% 6 dpf×3 inch regenerated PET). In these illustrative constructs 1-3, polypropylene represents the low melt fiber and a regenerated PET represents the high melt fiber. In addition, for constructs 1-3, for example, the polypropylene fibers and regenerated PET fibers can have the same, different, or mixed colors.

Layers 11*a* and 12*a* of nonwoven precursor web 1 are unneedled precursors of fibrous batt layers 11 and 12, respectively, of nonwoven multilayered thermal compression moldable fibrous batt 10. Fibrous batt 10 is formed by a needle-punching treatment applied to nonwoven precursor web 1. The needle punching treatment is discussed in more detail later herein. At this stage of processing, the nonwoven precursor web 1 is not a consolidated structure. In various embodiments, web layers 11*a* and 12*a* (and the optionally additional one or two web layers) are formed in substantially similar or different thicknesses at this stage of processing. The thicknesses of web layers 11*a* and 12*a* (and the optionally additional one or two web layers) are not necessarily limited other than by practical considerations. In various embodiments, the carded web layers 11*a* and 12*a* (and the optionally additional one or two web layers) each can have a thickness, for example, of about 2.5 cm to about 65 cm, or about 10 cm to about 40 cm, or other thickness values can be used. In various embodiments, the basis weights for web layers 11*a* and 12*a* are in the range of about 500 gsm to about 1500 gsm, or about 600 gsm to about 1200 gsm. It will be understood that the basis weight of the layers is essentially the same before and after needle punching.

In various embodiments, the web layers 11*a* and 12*a* (and the optionally additional one or two web layers) of the nonwoven precursor web 1 can have the same or different basis weights defined in terms of mass per unit area (e.g., $g/m^2$ or gsm). The precursor web layer also can have the same or different densities defined as mass per unit volume (e.g., $g/cm^3$). In various embodiments, a density difference can exist between the two (or more) unneedled web layers. In various embodiments, this density difference between the two (or more) unneedled web layers can be at least 2%, or at least 5%, or at least 10%.

As illustrated herein, multiple cards supplied by dedicated fiber mixers can be used to form multilayered nonwoven precursor web 1 comprising blends of different low melt/high melt fibers at different thickness regions thereof. The carding machines can be conventional carding machines, adapted for this process. Commercial carding machines and systems are available, for example, from Erko-Triitzschler (Dülman, Germany). It will be appreciated that other web forming devices may be adapted to incrementally build-up precursor web layers comprised of the different fiber mixtures illustrated herein. In addition, nonwoven precursor web 1 optionally may be fed to drafting means (not shown), such as conventional nonwoven web drafting means used to draft, or stretch, the batt in the warp or longitudinal direction.

For example, and as also illustrated in FIG. 2, after making the precursor web layers 201, the resulting nonwoven precursor web 1 is then passed to mechanical needle punching operation 202, which comprises needling steps 28 and 29. These needling steps are comprised of Needle Punch Stages 1 and 2. In the illustration of FIG. 2, the nonwoven precursor web 1 is punched down partially through its thickness in step 28 and punched up partially through its thickness in step 29. The sequence of these steps can be reversed, or the steps could be performed simultaneously.

Figure 3:
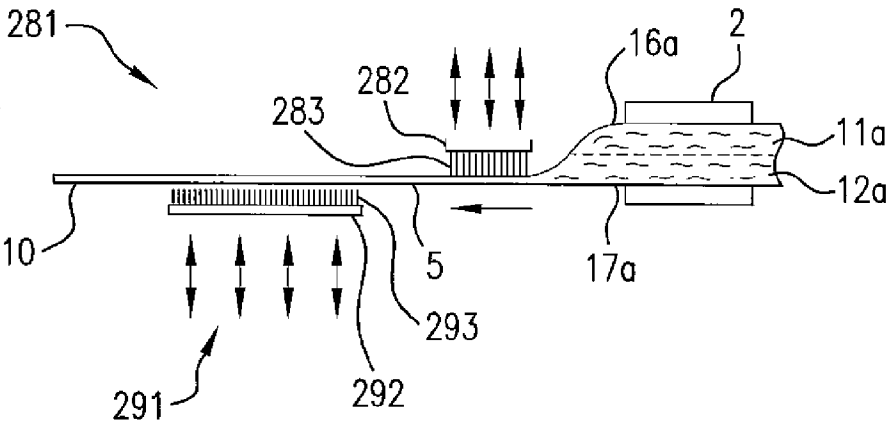
FIG. 3 is a simplified schematic side view of a part of a processing line on which a multilayered nonwoven precursor web receives needle-punching treatment according to an embodiment of the present invention.

As illustrated in FIG. 3, the multilayered nonwoven precursor web 1, which is illustrated as comprising unneedled nonwoven precursor web layers 11*a* and 12*a* in this non-limiting embodiment, can be consolidated after precursor web layer stacking and cross-lapping 27 by needle punching the precursor web from both sides. The needle punching can be performed from opposite sides simultaneously, or, as illustrated in FIG. 3, using several separate stages of needling from each side of the web. The needle punching operation compacts the precursor web and forms an intertufted region that joins the precursor web layers. The thickness of the nonwoven precursor web becomes incrementally more permanently compressed as it passes through the multiple stages of needle punching.

As illustrated in FIG. 3, in various embodiments, the needle-punching is conducted partially through the thickness of the web from its opposite sides 16*a* and 17*a* using separate down-stroking needle loom 281 and an up-stroking needle loom 291. A particular representative mechanical needling process also includes the use of a V-shaped compression belt feeder (not shown) to the needle looms to reduce the excessive bulk of the nonwoven precursor web to a height suitable for mechanically needling. Typically, the precursor web is compressed at an overall rate of at least about 25-27:1. In other words, a precursor web that begins with a thickness of about 50 inches, for example, may end up being about 2 inches thick after the needle-punching process is complete. For another example, a precursor web that begins with a thickness of 135 cm may end up being 5 cm after the needlepunching process. As also illustrated in FIG. 3, in each needle loom 281 and 291, there is a needle board 282 and 292, respectively, having a plurality of needles 283 and 293, respectively, attached thereto, which extend a distance from the surface of each needle board. Each needle loom 281 and 291 comprises a means (not shown) for moving the needle board of each loom in a generally vertical reciprocating motion having a first needling direction and a second needling direction towards and away from the workpiece or web as indicated by double arrows in FIG. 3.

As generally known in the art, the needles in a needle board can be aligned with holes in a stripper plate and bedplate (not shown) through which the object to be needled passes. The reciprocating motion of the needle board forces the needles in and out of the holes in the stripper and bedplate and thus in and out of the object to be needled since the object to be needled is positioned between the stripper plate and the bedplate. The needles are set to reciprocate partially through the fabric. Barbed needles generally have long blades covered with small barbs towards one end which carry fibers from a horizontal position within a web into a more vertical position during the stroke. Barbs on the needles catch the fibers, and push some of them vertically towards the opposite side of the web (i.e., in the "z" direction), and release them as the needle is withdrawn. One directional needling allows the needle to exit the fibers cleanly before re-penetrating the web again. Through repeated strokes or punches into the web, the web becomes more densified in the punched regions forming a fibrous batt. The barb angle can be selected over a wide range. The barb angle can be, for example, within about 25°, or within about 5°, with respect to vertical, although other barb angles can be used.

Dilo needle looms, such as commercially available from Oskar Dilo Maschinenfabrik KG (Eberbach, Germany), or other commercially available needle looms, can be adapted for use in the needling process of the present invention. One exemplary Dilo needle loom that can be used is Dilo Model Di-loom DBF VE-2. Hyperpunch systems where the needles follow an elliptical path rather than straight up and down also may be used.

In various embodiments, a target density (e.g., in g/cm$^3$) for the overall needle punched batt is selected prior to performing needle punching. As discussed, needle punching precursor webs according to embodiments of the present invention provides a consolidated batt product having substantially uniform density throughout. Based on the selected target density of the needled batt product, and known compositions and basis weights of each constituent precursor web layer of the unneedled nonwoven precursor web, the needles in the needle looms can be set to get the web or fabric to a compacted thickness by needle punching that will arrive or closely approach the target density (e.g., within 3%).

The basis weight of each precursor web layer will remain substantially constant through the needle punching operation to form fibrous batt layers, as the number of the fibers that are partly tufted from opposite directions into the adjoining batt layer is relatively small on a mass basis.

The density ("d") of a fibrous batt or layer in units mass/volume (e.g., g/cm$^3$) can be determined, for example, by multiplying a known basis weight ("BW") value of the batt or batt layer times the reciprocal of the thickness ("1/T") thereof. For example, this relationship can be represented by the formula: d=BW/T. Thus, batt or batt layer density (in units of g/cm$^3$) will equal the basis weight (in g/cm$^2$)×1/thickness (in cm). Also, if a target density is a preselected value for a batt, it is also possible to use the above formula to calculate the thickness of a batt layer having a known constant basis weight value that is needed to yield the selected density (i.e., T=BW/d). Thus, for example, if an overall consolidated (needled) batt density of 0.042 g/cm$^3$ was selected as the target density of the needled consolidated batt, and the basis weight of one of the unneedled precursor web layers is 1000 g/m$^2$ or gsm (0.1 g/cm$^2$), and the other unneedled precursor layer is 800 g/m$^2$ (0.08 g/cm$^2$), it can be calculated that the precursor web layers should be needled to respective thicknesses of about 2.4 cm thick, and about 1.9 cm thick, to arrive at the target density (i.e., thickness=basis weight/target density). For purposes of this non-limiting illustration, the needled batt thus would have an overall (total) thickness of about 4.3 cm.

As discussed, needle punching parameters are selected to provide the needed level of compaction of the respective batt layers and form an intertufted region. In various embodiments, and depending on the factors discussed above, needle punching consolidation of the nonwoven precursor web into the multilayered fibrous batt can reduce the precursor web thickness by a significant total factor, such as exceeding 10:1 or more, although not limited thereto.

Factors that are controlled in the needle punching operation that effect the compaction imparted to the precursor web and intertuft region forming are needle type, maximum barb penetration depth and punch density received from each side of the precursor web. The extent of mechanical compaction imparted to either side region of the precursor web is effected by the interplay of these parameters with respect to a particular fibrous workpiece. Important needle type features in this regard include, for example, the blade shape, barb shape, barb spacing, and needle length. The needle punching is controlled such that the needles partially, but not completely, extend through the thickness of the precursor web when received from opposite sides thereof. Punch density can be determined, for example, by multiplying the needle board revolutions per minute times needle density defined as needles/meter. Needles and punch densities can be selected in combinations to arrive at level of mechanical compaction imparted into each side of the precursor web that provides batt layer densities that are substantially the same throughout the batt. In addition, the needling from opposite sides of the fabric must provide an intertufted region within the batt sufficient to join the precursor web layers together to provide a unitary consolidated batt product.

Figure 4:
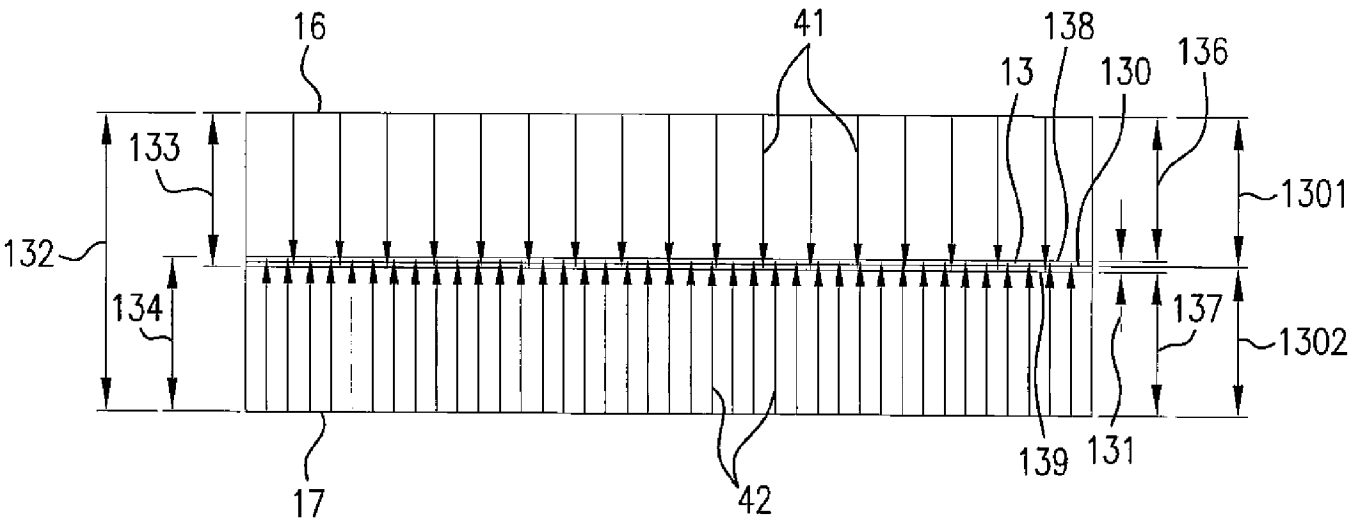
FIG. 4 is a simplified cross-section of view of the nonwoven multilayered thermal compression moldable fibrous batt of FIG. 1 showing representative needle-punching paths into the batt according to an illustrative embodiment of the present invention.

Referring to FIG. 4, representative needle barb penetration depths 133 and 134 of the barb paths are schematically indicated as paths 41 and 42. These barb paths are shown to partially extend, in opposite directions, through the thickness of batt construct from each opposite side 16 and 17. The barb penetration depths are controlled to limit the barb penetration from opposite web sides such that the needle penetration depths or distances partly overlap within the bulk of the web at intermediate intertufted region 13 that encompasses interface 130 of the needled batt layers 11 and 12. In this illustration, the interface 130 is spaced from outer side 16 a vertical distance 1301 and spaced from the opposite outer side 17 a vertical distance 1302. "Needle penetration depth" means the maximum distance the tip of the needles attached to the needle board move into the precursor web. Needle penetration can be controlled to provide partial depth penetration into, but not completely through, the nonwoven precursor web by the choice of the needle design and stroke distance, loom settings, and taking into account the web thickness. Referring still to FIG. 4, in various embodiments, the intertufted region 13 extends through a vertical distance 131 within the batt, and the needle punched batt 10 has a total thickness 132. The intertufted region is not visually discernible with the unaided eye from a side view of the needlepunched fibrous batt 10. It is a region where some fibers from both batt layers have been mutually pushed vertically in opposite directions into the adjoining batt layer to an extent sufficient to attach the batt layers together. The uppermost level 138 of intertufted region 13 is spaced a distance 136 from upper batt side 16, and lowermost level 139 of the intertufted region 13 is spaced a distance of 137 from lower batt side 17. In this illustration in FIG. 4, the ratio of intertufted region distance 131/total batt thickness 132 is less than one. The vertical distance 131 of the intertufted region 13 relative to the total batt thickness 132 can vary depending on the batt fiber composition, needling conditions, and how much intertufted region is needed to mechanically unite the separate batt layers into a unitary batt. Intertufted region thicknesses generally are provided such that the region remains spaced from opposite sides of the needle punched batt and leaves adequate fibrous batt layers having different low melt and high melt fiber proportions on either side thereof for subsequent molding operations used to form a multi-density article. The resulting needled batt layers 11 and 12 are united at the intertufted region 13 (FIG. 1), and the remaining batt regions (other than region 13) of the web will have received barb penetration from only one direction.

In one illustration of FIG. 3, a precursor web layer 11*a* of the nonwoven precursor web 1 receives less punching density from barbed needles at a pre-needling step 281 than what the precursor web layer 12*a* of the half punched precursor web 5 receives at subsequent needling step 291 using the same type of needles. In various non-limiting embodiments, one approximately 1000 gsm precursor web layer receives a needle-punching density of about 2800 to about 3200 strokes per meter (e.g., 1500 needles/meter, 850 rpm, 70 mm max. stroke distance) using CBA and conical type needles manufactured by Foster Needle Co., Inc. of Manitowoc, Wis., and an opposite approximately 800 gsm precursor web layer of the same precursor web thereafter receives a needle-punching density of about 4800 to about 5200 strokes/meter (e.g. (3000 needles/meter, 950 rpm, 60 mm max. stroke distance) using conical type needles.

The resulting needle-punched fibrous batt is made from at least two fibrous batt layers having substantially the same density while containing different proportions of a low melt fiber. In one embodiment, the differentially needle punched batt layers each have similar densities, such as within 10%, or within 5%, or within 1% (in units of mass/volume such as $g/cm^3$), of one another in the nonwoven multilayered fibrous batt.

The mechanical needling, such as shown in FIGS. 2-4, is the preferred method for providing mechanical compaction and intertufted region formation as it can be readily adjusted depending on the processability requirements and yet does not introduce extraneous adhesive binders or other materials into the construction, which add cost and complexity and may not be re-usable materials for post-molding recycling. In addition, the different precursor web layers used in forming the needle punched batt can have the same basis weights, or, alternatively, can have different basis weights that differ by more than about 5%, or by more than about 10%, or at least about 25% and no more than about 50%, prior to the needle punching, yet still can be consolidated into a batt having substantially uniform density by the method of the present invention. In various embodiments, needle punching can be applied to the opposite sides 16*a* and 17*a* of precursor web 1 (and intermediate half punched web 5) as shown in FIG. 3 effective to reduce batt density differences that existed in the nonwoven precursor web 1 before needle punching and can equilibrate the densities of the precursor web layers 11*a* and 12*a* of the nonwoven precursor web 1. Also, although the concepts of the invention are illustrated herein with reference to a needle punched fibrous batt formed with two precursor web layers, it will be understood that the concepts of the present invention also can be applied to any multiple number of precursor web layers up to and including four that are blended, carded, overlaid and needle punched together in accordance with embodiments such as illustrated herein.

As illustrated in FIG. 2, after needle punching, and prior to molding step 30, the resulting nonwoven multilayered fibrous batt can be wound, sheeted, trimmed, cut into discrete blanks, and/or packaged (not shown). These steps can have practical relevance, but are not essential to the process of the present invention.

A three dimensional molded article can be subsequently formed in a molding step 30 (e.g., thermal compression molding) from the unique nonwoven multilayered fibrous batt 10 having substantially uniform density throughout. In various embodiments, the nonwoven multilayered fibrous batt generally can be heated at molders with time and temperature sufficient to make the low melt fiber component melt and flow in the adjoining batt layers without exceeding the melting temperature of the other high melt component fiber of the same layers. The batt 10 can be readily thermal compression molded into complex shapes that develop stiffness and shape-retentive characteristics. In various embodiments, the result is a dual density batt, where each of the two batt layers has a homogeneous structure. A higher percentage of low melt fibers, such as may be provided in the bottom batt layer 12 causes more binding of the fibers together when the low melt fibers melt during thermal compression molding than occurs in the top batt layer 11, for example, containing a smaller proportion of the low melt fibers. That is to say, the fibrous batt layer that contains more low melt fiber molds "more densely" than the other fibrous batt layer that contains relatively less low melt fiber and thus molds more "lofty". In various embodiments, at least a 12%, or 18%, or 24%, or 30%, density difference is producible in the different batt layers upon thermal compression molding of the nonwoven multilayered fibrous batt. In various embodiments, the low melt fiber component can be the primary or sole binder component present in molding and consolidating the batt into a unitary molded structure. In various embodiments, the first and second precursor web layers of the batt each contain less than 5% by weight of total added binder resin added in addition to the first and second discontinuous fiber content, e.g., less than 5% by weight thermosettable binder material added in addition to the first and second discontinuous fiber content thereof. Usage amounts of thermosettable binders, e.g., those that can be problematic for recycling, can be reduced or eliminated.

Thermal compression molding basically can involve the pressing of a deformable material between two halves of a heated mold. Compression molding molds can be used on compression presses, which may be downstroking or upstroking types, and can be hydraulically operated (clamping ram or cylinder), although not limited thereto. Positive or semi-positive molds, for example, can be used to mold the nonwoven fibrous batts of the present invention. As known in the molding industry, part dimensions in the mold closing direction are directly dependent on the amount of material in the charge, as well as possible leakage or flash. Compression molding temperatures, pressures and setting times can vary depending on the batt fiber composition, desired part thickness, part shape, and so forth. Gap settings can be provided sufficient to allow the bottom layer of the nonwoven multilayered batt to densify while maintaining loft in the top layer, or vice versa.

Figure 5:
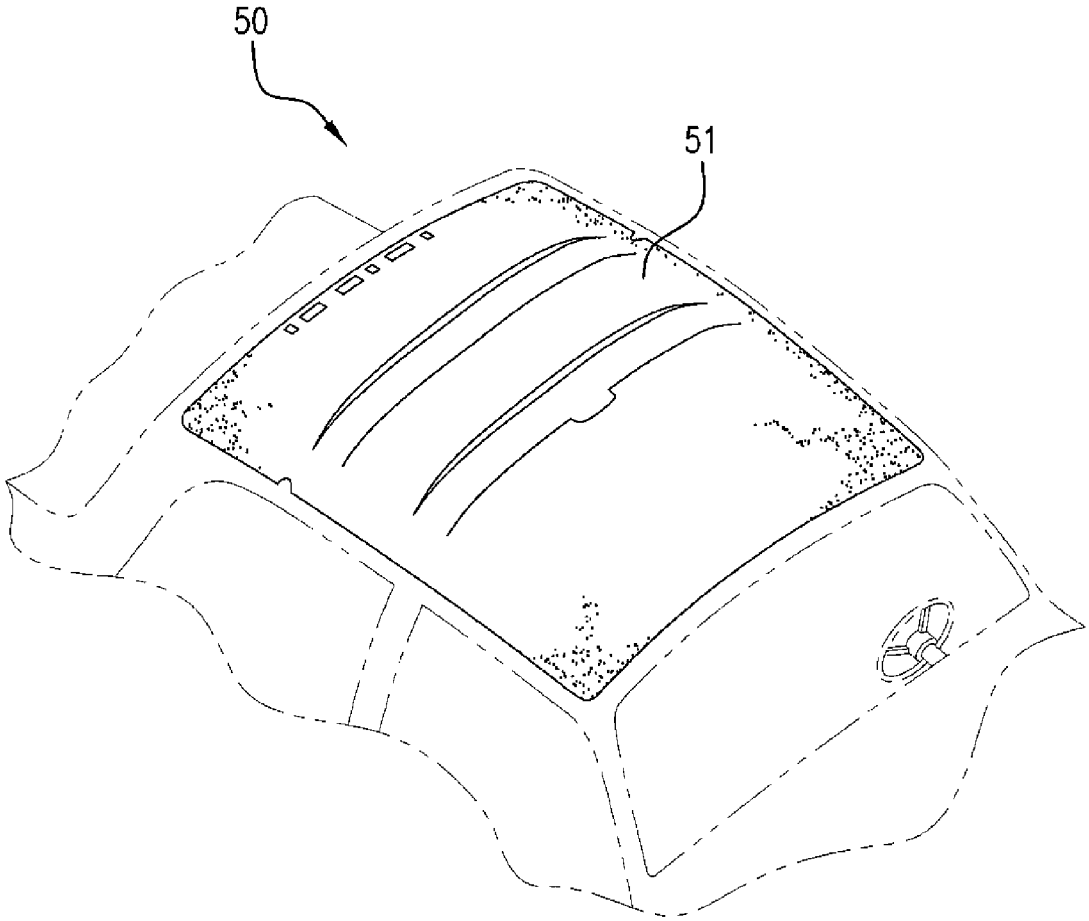
FIG. 5 is a perspective view showing a vehicle acoustical panel headliner made with a nonwoven thermal compression moldable fibrous batt according to an illustrative embodiment of the present invention.

In various embodiments, multi-density acoustical articles can be provided which include, but are not limited to, materials and parts used in systems for absorbing soundwaves and/or reducing sound transmission loss to control the acoustics in a vehicle. Referring to FIG. 5, an acoustical article 51 used as a vehicle interior panel, such as a headliner in a vehicle 50, is illustrated. Other vehicle liner applications are also contemplated, such as, for example, trunk liners, wheel well liners, floorboard liners, dash insulators, hush panels, HVAC ducts, package trays, trim fabrics.

Figure 6:
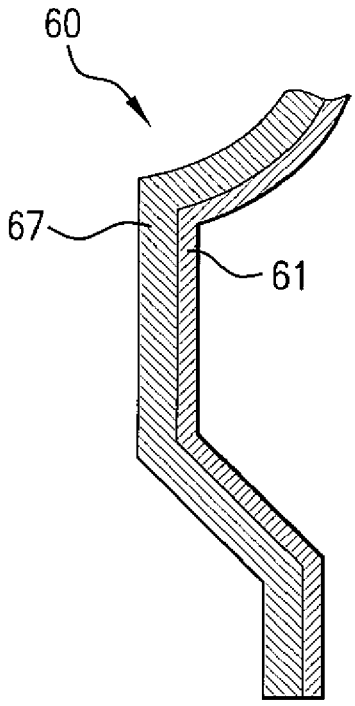
FIG. 6 is an enlarged cross-sectional view of a vehicular dash panel liner made with a nonwoven thermal compression moldable fibrous batt according to an illustrative embodiment of the present invention.
Figure 7:
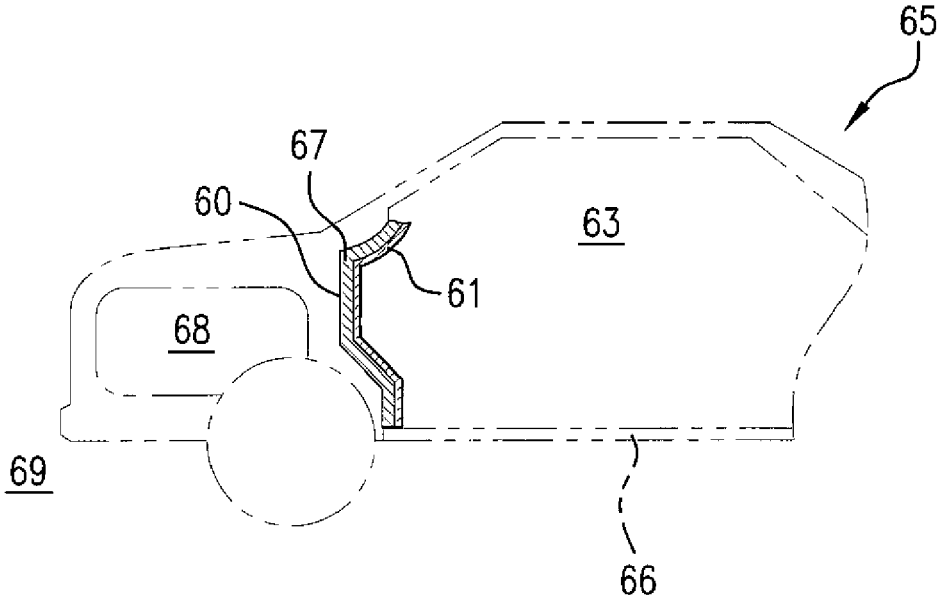
FIG. 7 is a schematic side sectional view showing the dash panel liner of FIG. 6 formed on a vehicular dash panel.

Referring to FIGS. 6 and 7, in various embodiments, dual density articles of the present invention can be installed within a vehicle, such as a molded dash insulator 60, in an arrangement wherein the higher density (low air permeability) portion 61 faces the vehicle interior (cabin) 63 of the vehicle 65 in order to absorb sound and keep music and conversation inside the cabin, and the lower density-lofty (higher air permeability) portion 67 faces towards the engine bay 68 in order to reduce sound transmission loss and keep engine noise out of the cabin and away from the driver; or, alternatively, the outside 69 of the vehicle such as installed as a floorboard liner 66 (indicated in outline only), in that orientation, such that engine and exterior noise can be kept out by the outside-facing lower density portion 67 of the liner 60 while the interior-facing higher density portion 61 of the liner can keep music and conversation inside the cabin by absorbing audio sounds, music and communications within the vehicle.

In various embodiments, dual density molded articles suitable for vehicle components can have an overall basis weight of about 1000 gsm to about 2400 gsm, or particularly about 1200 to about 2000 gsm. Molded products with other basis weights also can be provided. In various embodiments, a dual density molded article is formed from the batt comprising a molded first fibrous batt layer having a density of at least 0.3 grams/cm$^3$ and not greater than 3 grams/cm$^3$, and a second nonwoven fabric batt layer having a density of at least 3 grams/cm$^3$ and not greater than 15 grams/cm$^3$, wherein the second fibrous batt layer contains the low melt fiber in greater proportion than the first fibrous batt layer.

The needle punched multilayered fibrous batts also can be used in other molded article applications, such as, for example, non-vehicular sound barriers and/or sound absorbers, structural panels, pet beds, and so forth. These molded parts also can be formed in dual density formats in a single molding step using needle punched batts of the present invention.

In various embodiments, acoustical molded articles can be provided with needle punched multilayered fibrous batts of the present invention in which desired sound absorption and/or sound transmission loss characteristics of the molded articles can be dialed in using a similar starting batt material. For example, by merely adjusting molded part thickness, it is observed that molded parts can be provided using similar nonwoven multilayered batts of the present invention, which have a significantly different balance of sound absorption and sound transmission loss properties. In various embodiments, the dual density molded article generally has an airflow resistance of at least 200 Rayls and not greater than 5,000 Rayls. In other various embodiments, dual density molded articles having different balances of acoustical properties can be provided from the same starting multilayered batt material according to embodiments herein. For example, using a similar starting batt material made in accordance with the present invention, at a molded thickness of about 9 mm to about 11 mm, the resulting molded part can exhibit a sound transmission loss of about 1 to about 5 (dB), a primary absorption peak in the range of about 0.65 to about 0.75 between 4000 to 5000 Hz and an airflow resistance of about 200 Rayls to about 450 Rayls, while, at a molded thickness of about 3 mm to about 7 mm, the resulting molded part made from the same starting batt material can exhibit a sound transmission loss of about 10 to about 15 (dB), a primary absorption peak in the range of about 0.5 to about 0.6 between 2500 to 5000 Hz and an airflow resistance of about 2,000 Rayls to about 4,500 Rayls. As generally understood, air flow resistance directly affects the sound absorption and sound-transmitting characteristics of an acoustical material. Sound absorption acoustical properties of a molded article thus can be correlated to airflow resistance.

The present invention will be further clarified by the following examples, which are intended to be exemplary of the present invention. Unless indicated otherwise, all amounts, percentages, ratios and the like used herein are by weight.

EXAMPLES

Example 1

A multilayered fibrous batt material was prepared in accordance with teachings herein which was prepared by needle punching a nonwoven precursor web having the following precursor web layer compositions:

a 1000 gsm upper precursor web layer (10% mixed colored 12-20 dpf polypropylene (PP)/90% 6 dpf×3 inch regenerated polyethylene terephthalate (PET) over a 800 gsm lower precursor web layer (50% mixed colored 12-20 dpf PP/50% 6 dpf×3 inch regenerated PET). The polypropylene fibers can be obtained, for example, from any one of a number of vendors, such as Plastex (Sumter, S.C.). The regenerated PET can be obtained, for example, from any one of a number of vendors, such as under the tradename Black PET Regenerated from Barnet USA (Arcadia, S.C.).

A nonwoven precursor web was formed with multiple cards and crosslapping as described above. The precursor web was reduced in thickness to about 2 inches using a V-shape compression belt that fed a multi-staged Fehrer AG (of Germany) needle loom system (Fehrer machine models NL28 and NL26). A down-stroking, relatively lower density needle-punch was applied to the batt or web layer, i.e., the batt side containing the lower proportion of polypropylene fiber, and then, the opposite side of the batt received an up-stroking, higher density needle-punch. In this regard, the needle looms were arranged such that the upper, higher PP content precursor web layer received a needle-punching density of about 3000 strokes/meter (1500 pins/meter, 850 rpm, 70 mm max. stroke distance) using Foster CBA type needles, and the other lower precursor web layer received a needle-punching density of about 5000 strokes/meter (3000 pins/meter, 950 rpm, 60 mm max. Stroke distance) using Foster CBA type needles.

The resulting needle punched batt material was used in forming multiple molded articles ("variants"), in which molded part thickness was a variable that was investigated. The mold used comprised a 2008 model passenger vehicle trunk side mold. The molding conditions were convection heating to a core temperature of 200° C. then molded in chilled mold set at 40° C. for 60 seconds. Gap settings were set sufficient to allow the bottom layer to densify while maintaining some loft in the top layer in a one-step molding step. Acoustical properties of the variants were then determined and compared.

Figure 8:
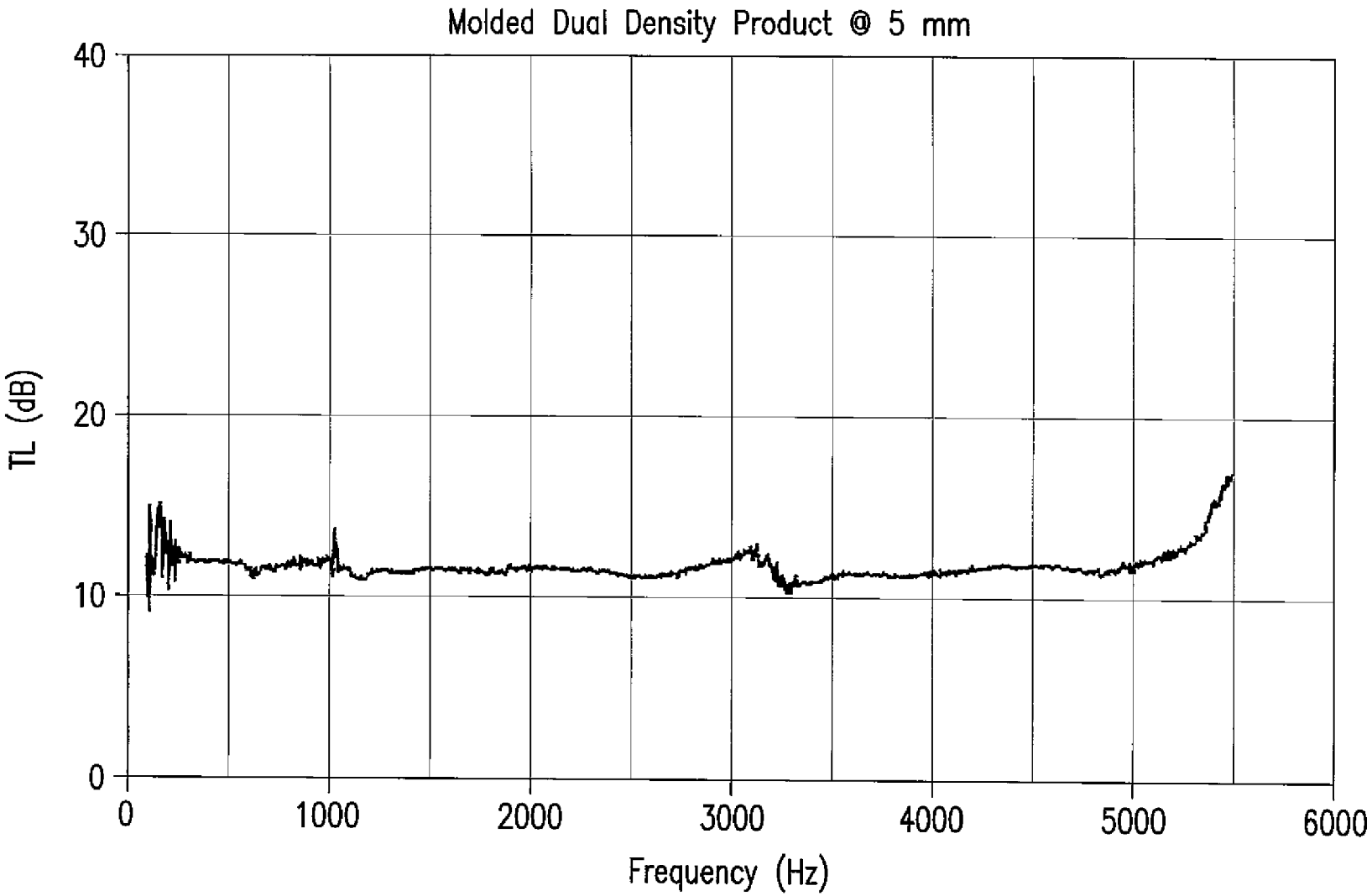
FIGS. 8 and 9 are graphs showing a sound transmission loss (dB) over a range of frequencies for molded dual density articles at two different thicknesses (5 mm and 11 mm), in which the molded articles are fabricated with the same type of nonwoven multilayered thermal compression moldable fibrous batt according to an illustrative embodiment of the present invention.
Figure 9:
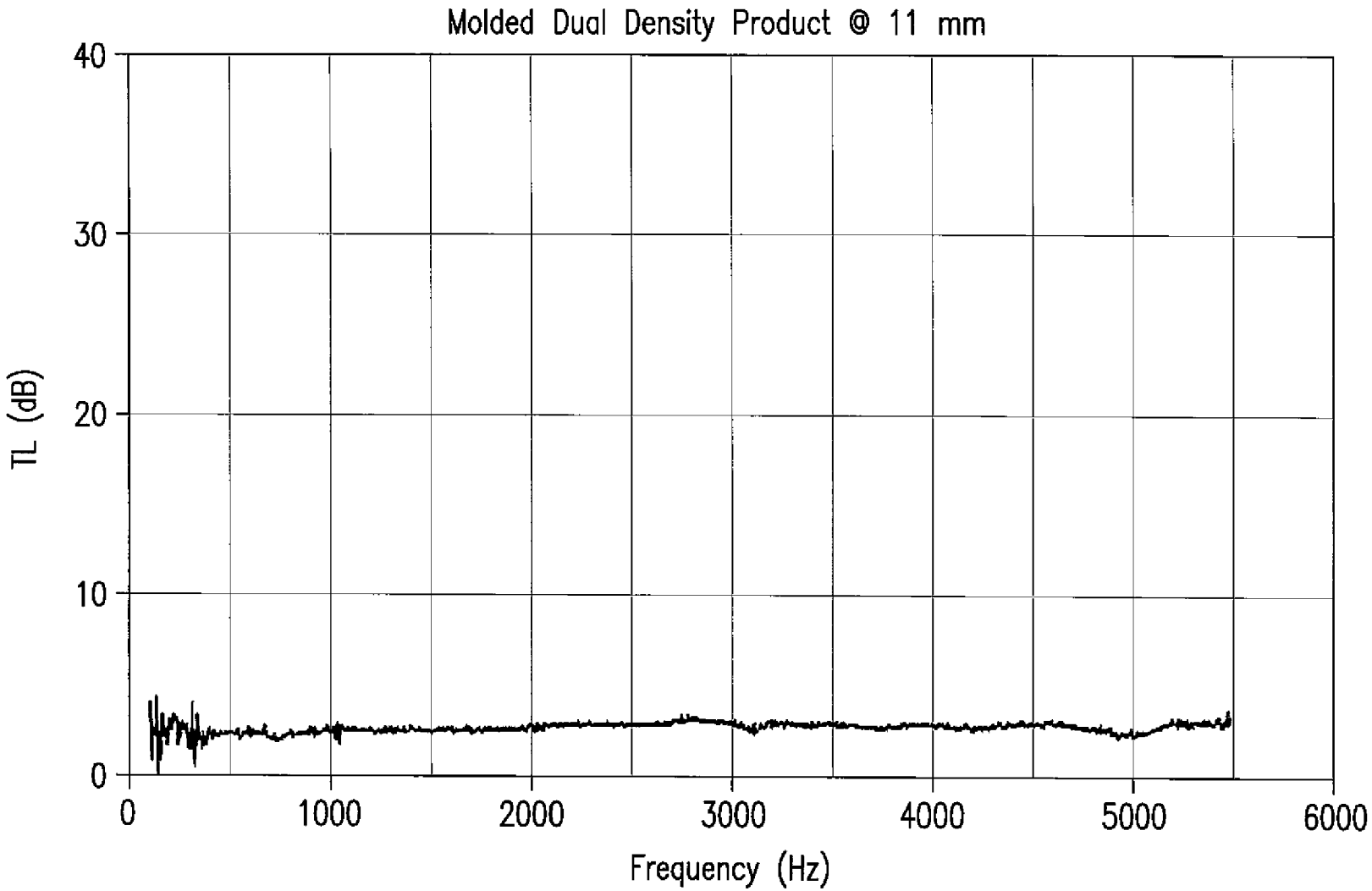

Test Procedures:

Sound absorption and sound transmission of the molded samples 1 and 2 were tested per ASTM E 1050-98 in a lab at room temperature, approximately 23° C., at 1 atmospheric pressure, and 50% relative humidity. The sample was mounted with the sound source coming toward the denser side of the sample, (i.e., denser side of the samples faced the noise source). The test was carried from about 500 Hz to about 5500 Hz. The sound transmission loss results are shown in FIGS. 8 and 9.

Airflow resistance of the molded samples was determined using a C522 Gas Permeameter that measures pressure difference and flow rate in the ranges recommended by ASTM standard C522-03. Resistance characteristics are computed from measured values. A number of characteristics of the test material, including specific air flow resistance (rayl), and airflow resistivity (rayl/m) were determined. The airflow resistance test results are shown in Table 1.

TABLE 1

| Variant | Airflow Resistance (Rayls) |
|---|---|
| Molded Dual Density Variant @ 5 mm | 3000-3500 Rayls |
| Molded Dual Density Variant @ 11 mm | 300-320 Rayls |

Test Results Discussion:

As shown in FIGS. 8 and 9, using the same variant, the absorption and transmission loss curves can be affected by the thickness chosen at molding. In FIGS. 8 and 9, the graphs show that the sound transmission loss was enhanced 400% by molding the variant to 5 mm versus 11 mm.

With regard to the sound absorption data, again using the same variant, the absorption properties were modified from a 0.5-0.6 absorption of sound over a broad spectrum (from 2500 to 5000 Hz.) to a primary absorption peak of 0.7 between 4000-5000 Hz. The airflow resistance measurements also showed that one mold variant could be custom molded, such as by changing molded part thickness, to provide a dual density product having a significantly different balance of sound absorption and sound transmission loss characteristics.

From the foregoing, it will be observed that modifications and variations can be affected without departing from the true spirit and scope of the novel concepts of the present invention. It is to be understood that no specific limitation with respect to the specific embodiments illustrated herein is intended or should be inferred. This invention can, however, be embodied in different forms and should not be construed as limited to the embodiments set forth herein; rather, these embodiments are provided so that this disclosure will be thorough and complete, and will fully convey the scope of the invention to those skilled in the art.

What is claimed is:

1. A nonwoven multilayered thermal compression moldable fibrous batt with substantially uniform density comprising:

a) needle punched first and second fibrous batt layers, wherein said first fibrous batt layer comprises a first discontinuous fiber and a second discontinuous fiber in a first proportional amount, and wherein said second fibrous batt layer comprises the first discontinuous fiber and the second discontinuous fiber in a second proportional amount that is different from said first proportional amount, and wherein melt point of said first discontinuous fiber is at least 30 degrees Celsius less than melt point of said second discontinuous fiber at same ambient conditions; and wherein said first and second fibrous batt layers are overlaid to define opposite outer surfaces; and b) an intertufted region uniting said first and second fibrous batt layers to form a nonwoven multilayered thermal compression moldable fibrous batt with substantially uniform density, wherein said first fibrous batt layer is an adjoining batt layer for the second fibrous batt layer, and the second fibrous batt layer is an adjoining batt layer for the first fibrous batt layer; and wherein said intertufted region is spaced from the opposite outer surfaces; and wherein (i) the intertufted region comprises fibers from both the first and second fibrous batt layers mutually pushed vertically in opposite directions into the adjoining batt layer to an extent sufficient to attach the first and second fibrous batt layers together, and (ii) the intertufted region having a thickness wherein the intertufted region remains spaced from the opposite outer surfaces of the needle punched first and second fibrous batt layers and leaves adequate first and second fibrous batt layers having different proportions of the first and second discontinuous fibers on either side of the intertufted region for subsequent molding operations used to form a multidensity article; and wherein a significant density difference is producible between the first and second fibrous batt layers of the nonwoven multilayered thermal compression moldable fibrous batt upon thermal compression molding thereof.

2. The nonwoven multilayered thermal compression moldable fibrous batt according to claim 1, wherein the first fibrous batt layer comprises at least 1% and not greater than 25% by weight of the first fibrous batt layer of first discontinuous fibers and said second fibrous batt layer comprises at least 30% by weight of the second fibrous batt layer of first discontinuous fibers.

3. The nonwoven multilayered thermal compression moldable fibrous batt according to claim 1, wherein the first fibrous batt layer comprises at least 1% and not greater than 25% by weight of the first fibrous batt layer of polyolefin fibers and at least 75% and not greater than 99% by weight of the first fibrous batt layer of polyester fibers; and wherein the second fibrous batt layer comprises at least 30% and not greater than 90% by weight of the second fibrous batt layer of polyolefin fibers and at least 10% and not greater than 70% by weight of polyester fibers.

4. The nonwoven multilayered thermal compression moldable fibrous batt according to claim 1, wherein the first fibrous batt layer comprises at least 5% and not greater than 25% by weight of the first fibrous batt layer of the first discontinuous fiber and at least 75% and not greater than 95% by weight of the first fibrous batt layer of the second discontinuous fiber; and the second fibrous batt layer comprises at least 30% and not greater than 60% by weight of the second fibrous batt layer of the first discontinuous fiber and at least 40% and not greater than 70% by weight of the second fibrous batt layer of the second discontinuous fiber.

5. A nonwoven multilayered thermal compression moldable fibrous batt with substantially uniform density comprising:

a) needle punched first and second fibrous batt layers, wherein said first fibrous batt layer comprises a first discontinuous fiber and a second discontinuous fiber in a first proportional amount, and wherein said second fibrous batt layer comprises the first discontinuous fiber and the second discontinuous fiber in a second proportional amount that is different from said first proportional amount, and wherein melt point of said first discontinuous fiber is at least 30 degrees Celsius less than melt point of said second discontinuous fiber at same ambient conditions, and wherein the second fibrous batt layer contains at least 5% proportionally by weight more of the first discontinuous fiber than the second discontinuous fiber than said first fibrous batt layer; and wherein said first and second fibrous batt layers are overlaid to define opposite outer surfaces; and b) an intertufted region uniting said first and second fibrous batt layers to form a nonwoven multilayered thermal compression moldable fibrous batt with substantially uniform density, wherein said first fibrous batt layer is an adjoining batt layer for the second fibrous batt layer, and the second fibrous batt layer is an adjoining batt layer for the first fibrous batt layer; and wherein said intertufted region is spaced from the opposite outer surfaces; wherein (i) the intertufted region comprises fibers from both the first and second fibrous batt layers mutually pushed vertically in opposite directions into the adjoining batt layer to an extent sufficient to attach the first and second fibrous batt layers together, and (ii) the intertufted region having a thickness wherein the intertufted region remains spaced from the opposite outer surfaces of the needle punched first and second fibrous batt layers and leaves adequate first and second fibrous batt layers having different proportions of the first and second discontinuous fibers on either side of the intertufted region for subsequent molding operations used to form a multidensity article; and wherein the first and second fibrous batt layers have respective densities that are within 12% of each other, and said second fibrous batt layer becoming significantly more dense than said first fibrous batt layer upon thermal compression molding of the nonwoven multilayered thermal compression moldable fibrous batt.

6. The nonwoven multilayered thermal compression moldable fibrous batt according to claim 5, wherein the density of the second fibrous batt layer becomes at least 12% greater than the density of the first fibrous batt layer upon thermal compression molding of the nonwoven multilayered thermal compression moldable fibrous batt.

7. The nonwoven multilayered thermal compression moldable fibrous batt according to claim 5, wherein the first and second fibrous batt layers have respective densities that are within 5% of each other.

8. The nonwoven multilayered thermal compression moldable fibrous batt according to claim 5, wherein the first fibrous batt layer comprises at least 5% and not greater than 25% by weight of the first fibrous batt layer of the first discontinuous fiber and at least 75% and not greater than 95% by weight of the first fibrous batt layer of the second discontinuous fiber; and the second fibrous batt layer comprises at least 30% and not greater than 60% by weight of the second fibrous batt layer of first discontinuous fiber and at least 40% and not greater than 70% by weight of the second fibrous batt layer of the second discontinuous fiber.

9. The nonwoven multilayered thermal compression moldable fibrous batt according to claim 5, wherein the first discontinuous fiber is polypropylene and the second discontinuous fiber is polyester.

10. The nonwoven multilayered thermal compression moldable fibrous batt according to claim 5, wherein less than 5% by weight of the multilayered thermal compression moldable fibrous batt is binder material that is neither first nor second discontinuous fibers.

11. The nonwoven multilayered thermal compression moldable fibrous batt according to claim 5, further comprising a third fibrous batt layer adjacent said second fibrous batt layer, wherein said third batt layer comprises the first discontinuous fiber and the second discontinuous fiber in a third proportional amount that is different from said second proportional amount, wherein the third fibrous batt layer contains at least 5% proportionally by weight different amount of the first discontinuous fiber than the second discontinuous fiber than said second fibrous batt layer; and, optionally, further comprising a fourth fibrous batt layer adjacent said third fibrous batt layer, wherein said fourth batt layer comprises the first discontinuous fiber and the second discontinuous fiber in a fourth proportional amount that is different from said third proportional amount, wherein the fourth fibrous batt layer contains at least 5% proportionally by weight different amount of the first discontinuous fiber than the second discontinuous fiber than said third fibrous batt layer.

12. The nonwoven multilayered thermal compression moldable fibrous batt according to claim 5, wherein the melt point of said first discontinuous fiber is at least 60 degrees Celsius less than melt point of said second discontinuous fiber at same ambient conditions.

13. The nonwoven multilayered thermal compression moldable fibrous batt according to claim 5, wherein the melt point of said first discontinuous fiber is at least 80 degrees Celsius less than melt point of said second discontinuous fiber at same ambient conditions.

14. The nonwoven multilayered thermal compression moldable fibrous batt according to claim 5, wherein the melt point of said first discontinuous fiber is at least 100 degrees Celsius less than melt point of said second discontinuous fiber at same ambient conditions.

15. An acoustical molded article made by thermal compression molding the fibrous batt of claim 1, wherein said molded first and second fibrous batt layers have a significant density difference, and the molded article has an airflow resistance of at least 200 Rayls and not greater than 5,000 Rayls.

16. The acoustical molded article of claim 15, wherein the density difference is greater than 12%.

17. The acoustical molded article of claim 15, wherein said molded first fibrous batt layer has a density of at least 0.3 grams/cm$^3$ and not greater than 3 grams/cm$^3$, and the second nonwoven fabric batt layer has a density of at least 3 grams/cm$^3$ and not greater than 15 grams/cm$^3$.

18. The acoustical molded article of claim 15, wherein the article has a thickness of at least 1 millimeter and not greater than 15 millimeters.

19. The acoustical molded article of claim 15, wherein the acoustical molded article exhibits, at a molded thickness of about 9 mm to about 11 mm, a sound transmission loss of about 1 to about 5 (dB), a primary absorption peak in the range of about 0.65 to about 0.75 between 4000 to 5000 Hz and an airflow resistance of about 200 Rayls to about 450 Rayls.

20. The acoustical molded article of claim 15, wherein the acoustical molded article exhibits, at a molded thickness of about 3 mm to about 7 mm, a sound transmission loss of about 10 to about 15 (dB), a primary absorption peak in the range of about 0.5 to about 0.6 between 2500 to 5000 Hz and an airflow resistance of about 2000 Rayls to about 4500 Rayls.

21. An acoustical molded article made by thermal compression molding the fibrous batt of claim 5, wherein said molded first and second fibrous batt layers have a significant density difference, and the molded article has an airflow resistance of at least 200 Rayls and not greater than 5,000 Rayls.

22. A vehicle liner comprising the acoustical molded article of claim 15.

23. A process for making a nonwoven multilayered thermal compression moldable fibrous batt with substantially uniform density, comprising:

a) blending a first discontinuous fiber and a second discontinuous fiber in a first proportional amount to form a first precursor web layer, wherein melt point of said first discontinuous fiber is at least 30 degrees Celsius less at ambient conditions than melt point of said second discontinuous fiber;

b) blending the first discontinuous fiber and the second discontinuous fiber in a second proportional amount to form a second precursor web layer, said first proportional amount and said second proportional amount being different;

c) laying the first precursor web layer on the second precursor web layer to form a nonwoven precursor web, wherein said first precursor web layer is an adjoining precursor web layer for the second precursor web layer, and the second precursor web layer is an adjoining precursor web layer for the first precursor web layer;

d) needle punching partially through the nonwoven precursor web from opposite sides thereof to unite the first and second precursor web layers and to form an intertufted region spaced from opposite sides of the needled punched nonwoven precursor web, wherein (i) the needlepunching comprises mutually pushing fibers vertically in opposite directions into the adjoining precursor web layer to an extent sufficient to attach the first and second precursor web layers together at the intertufted region, and (ii) forming the intertufted region to have a thickness wherein the intertufted region remains spaced from the opposite sides of the needle punched nonwoven precursor web adequate to leave first and second precursor web layers having different proportions of the first and second discontinuous fibers on either side of the intertufted region for subsequent molding operations used to form a multidensity article, thereby forming a nonwoven multilayered thermal compression moldable fibrous batt with substantially uniform density, wherein a significant density difference is producible between the first and second precursor web layers upon thermal compression molding of the nonwoven multilayered thermal compression moldable fibrous batt.

24. The process of claim 23, wherein said needle punching comprises a needle punching operation conducted in sequential separate stages from opposite sides of the nonwoven precursor web.

25. The process of claim 24, wherein said needle punching further comprises barbed needle punching providing penetration depths from both of the opposite sides that extend only partially through an overall thickness of the nonwoven precursor web to form the intertufted region between and spaced from said opposite sides of the batt.

26. The process of claim 23, wherein the first and second precursor web layers having first and second basis weights, respectively, that differ by at least 10% prior to said needle punching.

27. The process of claim 23, wherein the first and second precursor web layers having first and second basis weights, respectively, that differ by at least about 10% and not greater than about 50% prior to said needle punching.

28. The process of claim 23, further comprising carding each precursor web layer before laying the first precursor web layer on the second precursor web layer to form a nonwoven precursor web.

29. The process of claim 23, further comprising crosslapping each precursor web layer before laying the first precursor web layer on the second precursor web layer to form a nonwoven precursor web.

30. The process of claim 23, wherein the blending to form said first precursor web layer comprises mixing at least 1% and not greater than 25% by weight of the first precursor web layer of polyolefin fibers and at least 75% and not greater than 99% by weight of the first precursor web layer of polyester fibers; and the blending to form said second precursor web layer comprises mixing at least 30% and not greater than 90% by weight of the second precursor web layer of polyolefin fibers and at least 10% and not greater than 70% by weight of the second precursor web layer of polyester fibers.

31. The process of claim 23, wherein the blending to form said first precursor web layer comprises mixing at least 5% and not greater than 25% by weight of the first precursor web layer of polypropylene fibers and at least 75% and not greater than 95% by weight of the first precursor web layer of polyester fibers; and the blending to form said second precursor web layer comprises mixing at least 30% and not greater than 60% by weight of the second precursor web layer of polypropylene fibers and at least 40% and not greater than 70% by weight of the second precursor web layer of polyester fibers.

32. The process of claim 23, wherein the first and second precursor web layers are free of fusion bonding at an interface of the first and second precursor web layers, and wherein the intertufted region comprises a generally horizontally extending region located between and spaced from the opposite outer surfaces.

33. The process of claim 23, wherein the first and second precursor web layers each contain less than 5% by weight of thermosettable resin.

34. The nonwoven multilayered thermal compression moldable fibrous batt according to claim 1, wherein the intertufted region comprises a generally horizontally extending region located between and spaced from the opposite outer surfaces.

* * * * *